United States Patent [19]

Mori et al.

[11] Patent Number: 4,603,654

[45] Date of Patent: Aug. 5, 1986

[54] GLUE APPLICATOR FOR CORRUGATOR MACHINES

[75] Inventors: Kazuo Mori, Kyoto; Eiichi Isowa, Nagoya, both of Japan

[73] Assignee: Isowa Industry Company, Ltd., Nagoya, Japan

[21] Appl. No.: 703,476

[22] Filed: Feb. 20, 1985

[30] Foreign Application Priority Data

Feb. 20, 1984 [JP] Japan ..... 59-30898

[51] Int. Cl.[4] ..... B05C 1/08; B05C 1/16

[52] U.S. Cl. ..... 118/202; 156/208; 165/145; 165/109.1

[58] Field of Search ..... 118/202, 602; 165/158, 165/109 R, 145; 156/205, 208, 210, 308.8

[56] References Cited

U.S. PATENT DOCUMENTS

| | | | |
|---|---|---|---|
| 3,316,961 | 5/1967 | Dorner | 165/145 |
| 3,911,179 | 10/1975 | Goettsch | 118/202 X |
| 4,395,968 | 8/1983 | Wahnschaff et al. | 118/202 X |
| 4,419,173 | 12/1983 | Akiyama et al. | 156/210 X |

*Primary Examiner*—John P. McIntosh
*Attorney, Agent, or Firm*—Schwartz & Weinrieb

[57] ABSTRACT

Disclosed herein is a glue applicator for a corrugator machine in which a starch glue in a glue pan is applied to ridge portions of a corrugated core sheet by an applicator roll, the applicator comprising: a stock tank holding a stock of starch glue; a glue heater having a couple of upper and lower glue pooling chambers for reserving the starch glue supplied from the stock tank, a heat medium chamber defined between the upper and lower pooling chamber and holding a heat medium, a plural number of heat exchange pipes inserted vertically across the heat medium chamber in contact with said heat medium and communicating at the upper and lower ends with the upper and lower pooling chambers to permit flows of the starch glue between the upper and lower pooling chambers, and a steam blow pipe opened into a bottom portion of the heat medium chamber for blowing steam thereinto; and a glue feed pipe connecting the upper pooling chamber of the glue heater to the glue pan.

20 Claims, 5 Drawing Figures

GLUE APPLICATOR FOR CORRUGATOR MACHINES

BACKGROUND OF THE INVENTION

1. Field of the Invention

This invention relates to a glue applicator for corrugated board manufacturing machines, and more particularly to a starch glue applicator in which a starch glue to be used for bonding a liner to a corrugated sheet is preheated to a predetermined temperature to shorten the time required for gelation adhesion of the starch glue, while realizing a significant reduction in equipment cost.

2. Description of the Prior Art

The corrugation machines intended for single-faced corrugated board or double-faced dual corrugated board generally employs a starch glue for a glue applicator which applies the glue on ridges of flutes of a corrugated core sheet to which a liner or facing sheet is to be bonded. Such starch glue is normally in the form of a suspension of low viscosity which is (in the case of the Stein Hall method) composed of a mixture of a main part containing starch and water in appropriate proportions and a carrier part containing starch and caustic soda in suitable proportions. The starch glue is stored in a glue pan which constitutes part of the glue applicator, and applied in a suitable amount on the ridge portions of a corrugated paper by means of an applicator roll. The corrugated sheet with the starch glue applied on the ridge portions of its flutes is bonded to a liner and then fed into a predetermined heating zone in which the applied glue is heated to a gelling temperature to develop its strong adhesive force. In this connection, the gelling temperature of a starch glue is about 60° C. (though such varies depending upon its composition), but the starch in the glue pan is maintained approximately at ambient temperature so that it needs to be heated up to the gelling temperature by the use of a heater in order to develop its inherent adhesive force to guarantee a strong bond of the liner to the corrugated sheet. However, it is often the case that such a heater is extremely lengthy and has a drawback that it occupies a large space of a corrugator line.

For example, FIG. 1 schematically shows a glue applicator and a double backer mechanism for producing double-faced corrugated board. A pair of single-faced corrugated boards 10 and 12 produced respectively by single facers, which are located in upstream positions, are preheated through preheaters 14 and 16 on the way to glue applicators 18 and 20 where glue is applied to the ridges of the respective corrugated board. The back liner of the single-faced corrugated board 12 and a liner 24 which is fed through another preheater 22 are bonded to the ridges of the corrugations of the single-faced corrugated boards 10 and 12, respectively, between guide rolls 26 which are located downstream of the glue applicator. Each one of the glue applicators 18 and 20 is provided with an applicator roll 28 and a doctor roll 30 in the usual manner, applying the starch glue 34 in the glue pan 32 to the ridges of the single-faced corrugated board through the applicator roll 28. As mentioned hereinbefore, the starch glue 34 in the glue pan 32 is approximately at the ambient temperature, so that it has to be heated to the gelling temperature to produce its adhesive force. For this purpose, it has been the conventional practice to provide a heater over a large distance along the corrugator line, including heat boxes 36, a ballast roll 38 and a belt 40. The heating boxes 36 are constituted by a hollow box of iron casting with thick walls, and heated by internally flowing steam to transmit heat to glued portions of a double-faced corrugated board which is passed along the surfaces of the heat boxes, thereby attaining adhesion through gelation of the glue which is applied on the ridge portions of the corrugated paper. However, these days the corrugator lines are operated at high speeds, passing corrugated boards at a high speed through a heating zone which is constituted by the heat boxes 36. This naturally necessitates to provide a very lengthy heating zone in order to heat the corrugated board up to the gelling temperature of the starch glue. In other words, the provision of a lengthy heating zone has been unavoidably required to comply with the demand for the speed-up of operations. Thus, it has been a matter of great concern in the art to omit or minimize the heating zone which invariably occupies a large space in the conventional corrugation lines. Besides, the starch glue in the conventional glue applicators largely depends on the ambient temperature and therefore the corrugated board production efficiency is greatly influenced by variations in ambient temperature or by seasonal temperature variations. A difficulty is also encountered in that the corrugated sheets suffer from warping or other defects due to excessive heat transfer from the heat boxes 36 when the operational speed is slowed down.

SUMMARY OF THE INVENTION

In an attempt to solve the above-mentioned drawbacks or problems of the prior art glue applicators, the present inventors have conducted an extensive study and as a result found that it becomes possible to shorten to a considerable degree the heating time which is required for gelation of the starch glue after bonding a corrugated sheet and a liner together and at the same time to reduce the installation space of a heater, by preheating a starch glue in the glue applicator (more precisely a starch glue which is circulated between the glue applicator and a stock tank) to a predetermined temperature range.

It is therefore an object of the present invention to provide a glue applicator for corrugating machines, which can shorten the time for heating a corrugated board to a gelation temperature of a starch glue after bonding glued ridge portions of a corrugated sheet to a liner, thereby permitting a reduction in the space required for a heating zone for economical use of a space in a corrugated board manufacturing plant while enhancing the production efficiency.

According to the present invention, the foregoing objective is achieved by the provision of a glue applicator for a corrugator machine in which a starch glue in a glue pan is applied to ridge portions of a corrugated core sheet by means of an applicator roll, characterized in that the glue applicator comprises: a stock tank holding a stock of starch glue; a glue heater having a couple of upper and lower glue pooling chambers for reserving the starch glue supplied from the stock tank; a heat medium chamber defined between the upper and lower pooling chambers and holding a heat medium therein, a plurality of heat exchange pipes inserted vertically across the heat medium chamber in contact with the heat medium and communicating at the upper and lower ends with the upper and lower pooling chambers to permit flow of the starch glue between the upper and lower pooling chambers, and a steam blow pipe opened into a bottom portion of the heat medium chamber for blowing steam thereinto; and a glue feed pipe connecting the upper pooling chamber of the glue heater to the glue pan.

The study by the inventors have also revealed that the heating of the starch glue can be accelerated to a significant degree by, in addition to the preheating of starch glue in the glue pan to a predetermined temperature range, blasting hot saturated steam on the starch applied on the ridge portions of a corrugated sheet immediately before bonding a liner thereto to heat up the starch quickly.

According to the invention, there is also provided a glue applicator for a corrugation machine in which a glue in a glue pan is applied to ridge portions of a corrugated core sheet by an applicator roll, characterized in that the glue applicator comprises: a stock tank holding a stock of starch glue; a glue heater having a couple of upper and lower glue pooling chambers for reserving the starch glue supplied from the stock tank; a heat medium chamber defined between the upper and lower pooling chambers and holding a heat medium therein, a plurality of heat exchange pipes inserted vertically across the heat medium chamber in contact with the heat medium and communicating at the upper and lower ends with the upper and lower pooling chambers to permit flow of the starch glue between the upper and lower pooling chambers, and a steam blow pipe opened into a bottom portion of the heat medium chamber for blowing steam thereinto; a glue feed pipe connecting the upper pooling chamber of the glue heater to the glue pan; and a steam blow pipe located immediately upstream of a position where the corrugated core sheet is bonded to a liner after application of the glue, and having a row of steam blow holes each directed to glue-bearing ridge portions of said corrugated core sheet.

BRIEF DESCRIPTION OF THE DRAWINGS

The above and other objects, features and advantages of the invention will become apparent from the following description and appended claims, taken in conjunction with the accompanying drawings which show by way of example some preferred embodiments of the invention, wherein: in the accompanying drawings:

DESCRIPTION OF PREFERRED EMBODIMENTS

Figure 1:
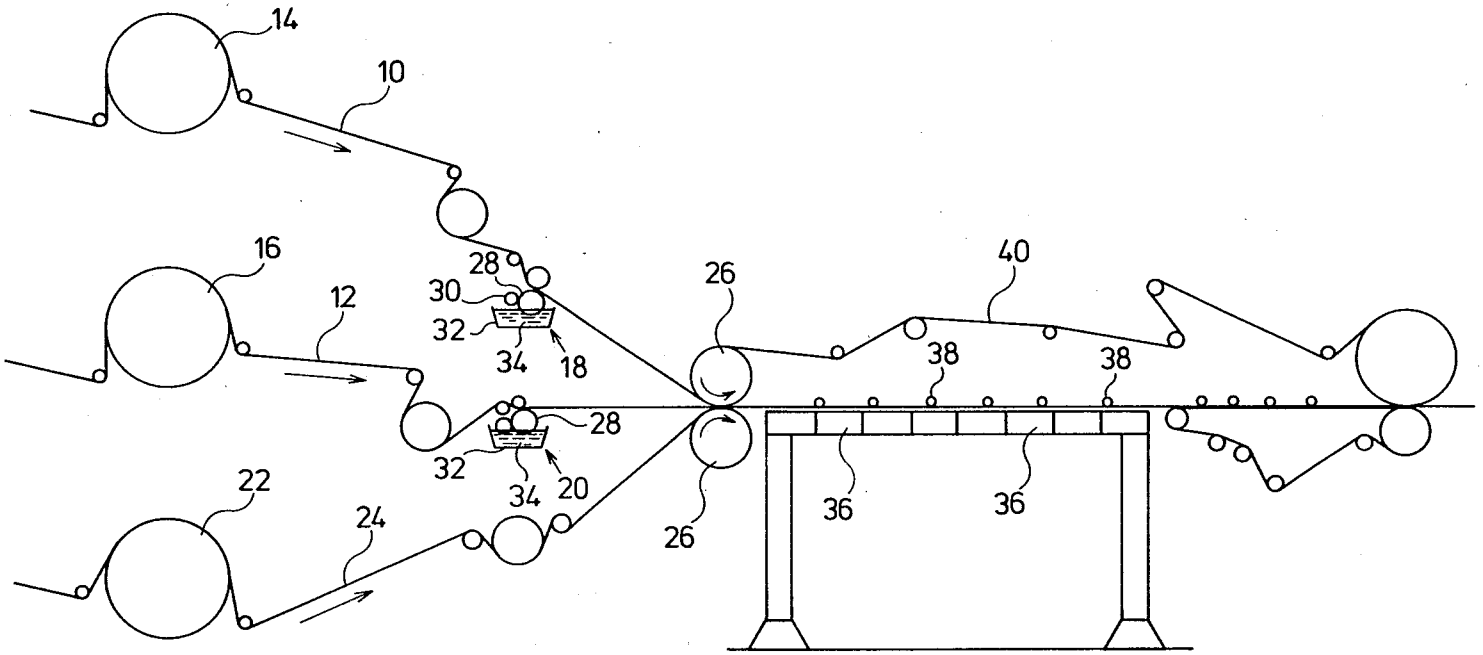
FIG. 1 is a schematic view of glue applicators and heat boxes for heating bonded corrugated sheet and liner in a conventional corrugation line.

Hereafter, the glue applicator according to the invention is described more particularly by way of a preferred embodiment shown in the drawings.

Figure 2:
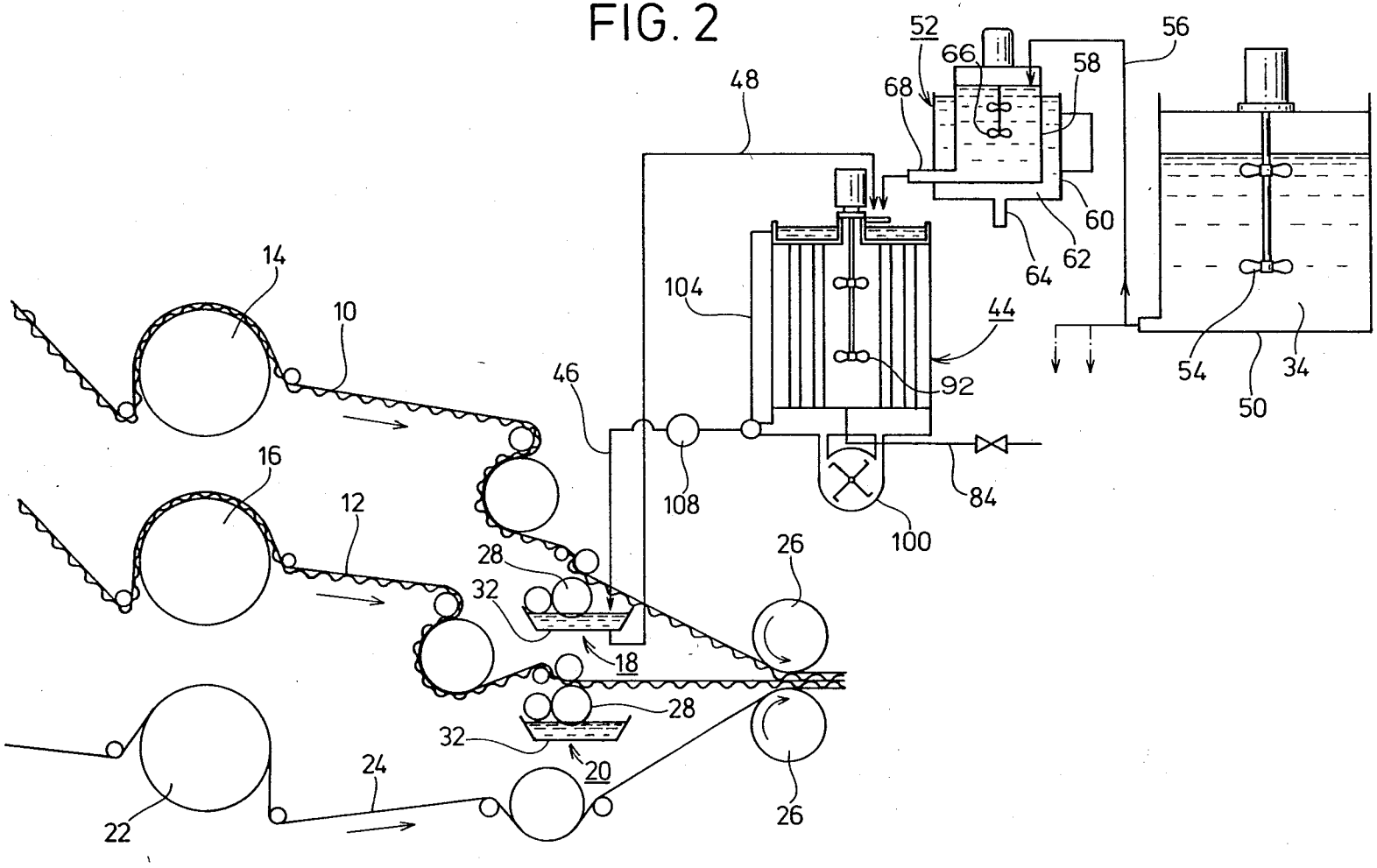
FIG. 2 is a schematic view of a corrugation machine incorporating a glue applicator according to the invention.

Referring to FIG. 2, there is schematically shown a glue applicator embodying the invention, which is suitable for use as a glue machine in the production of double-faced dual corrugated board as shown in FIG. 1 and also as a glue machine in the production of single-faced corrugated board by the use of a single facer or in the production of double-faced corrugated board. In FIG. 2, those parts which are common to FIG. 1 are designated by the same reference numerals for the sake of convenience.

Referring to FIG. 2, a glue pan 32 of a glue applicator 18 is in communication with a heater 44 which heats up the starch glue to a predetermined temperature range (as will be described hereinlater), through a glue feed pipe 46 and a glue return pipe 48. The heater 44 is in communication with a tank 50 which holds a stock of the starch glue and which supplies the glue to the heater 44, through a subtank 52 in the particular embodiment shown, which is interposed between the stock tank 50 and heater 44 in the manner as described hereinlater.

In the particular embodiment shown in FIG. 2, the stock tank 50 holds a stock of the starch glue consisting of main and carrier parts containing starch, water and caustic soda in appropriate proportions as mentioned hereinbefore. The glue stock is stirred and constantly maintained in a uniform concentration by an agitator 54 which is provided in the stock tank 50. A pipe 56 which extends out from the bottom of the stock tank 50 is in communication with an inner tank 58 of the subtank 52. The pipe 56 is also connected to a plurality of similar subtanks not shown. The subtank 52 has a double-tank construction consisting of an outer tank 60 and an inner tank 58 which is located within the outer tank 60 and spaced a predetermined distance therefrom. The outer tank 60 holds a liquid heat medium such as water 62 to a predetermined level. A steam feed pipe 64 which is in communication with a steam source, not shown, is connected to the bottom of the outer tank 60 to blow saturated steam into water 62 for raising the water temperature to a level of, for example, 45° C.±2° C. The inner tank 58 receives the starch glue 34 from the stock tank 50 and holds it to a predetermined level, uniformly stirring the glue by an agitator 66. The starch glue 34 in the inner tank is maintained at a temperature of 40° C.+2° C. to 40° C.−2° C. through heat exchange with heated water in the outer tank. The warmed glue 34 is supplied to the heater 44 which will be described hereinlater, through a pipe 68 which is connected to the bottom of the inner tank 58.

Figure 3:
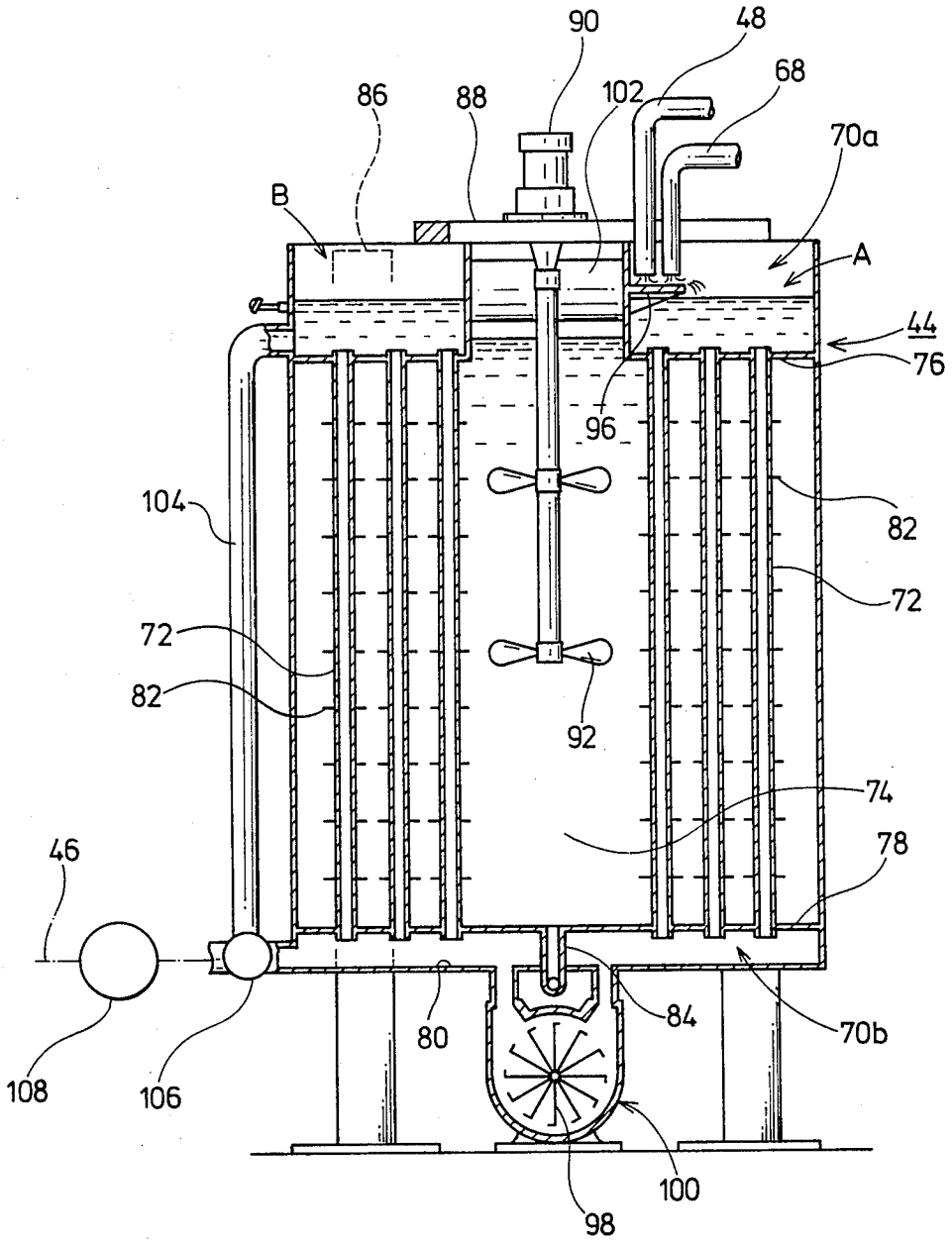
FIG. 3 is a schematic sectional view of a heater which constitutes a major component of the glue applicator according to the invention.
Figure 4:
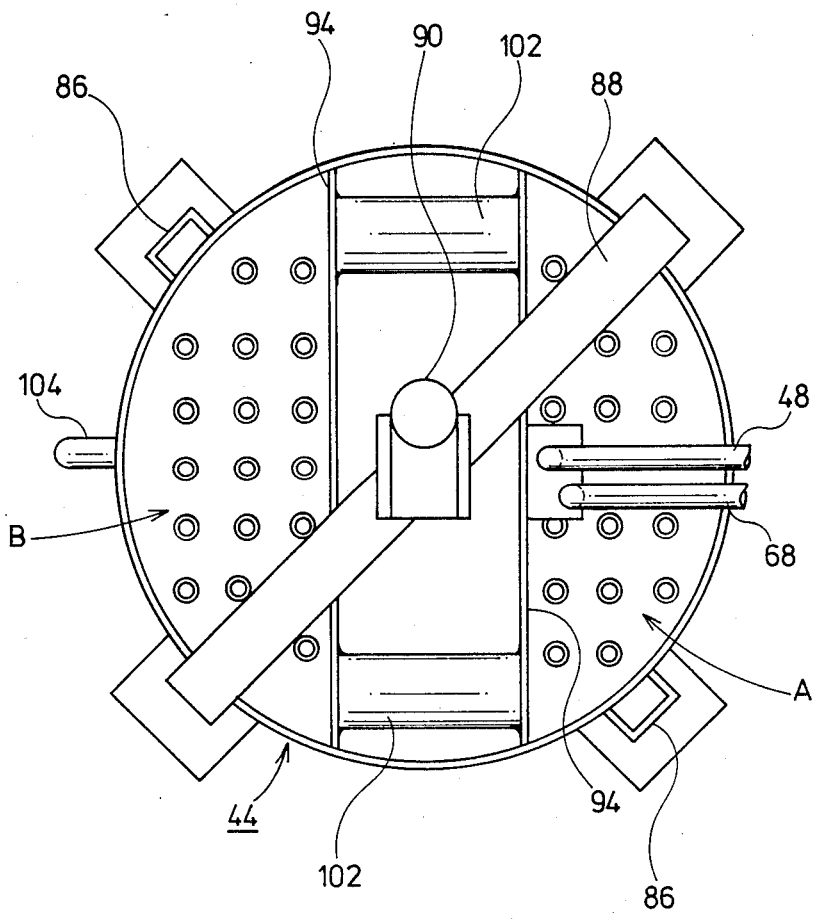
FIG. 4 is a schematic plan view of the heater shown in FIG. 3.

For details of the heater 44, reference is had to its vertical section and plan view of FIGS. 3 and 4. More particularly, the heater 44 is constituted by a cylindrical tank of a predetermined diameter which basically includes a pooling chamber 70 which receives the supply of the starch glue 34 from the subtank 52 (or from the stock tank 50 in a case where the subtank is omitted), a multitude of heat exchange pipes 72 which are connected to the pooling chamber 70 to permit passage therethrough of the glue starch 34, and a heat medium chamber 74 which circumvents the heat exchange pipes 72 through a heat medium such as water.

For example, the tank 44 is divided by a pair of horizontal partition plates 76 and 78 in the vicinity of its top and bottom portions, defining an upper pooling chamber **70*a* on the upper side of the upper partition plate 76 and a lower pooling chamber 70*b* between the lower partition plate 78 and the bottom wall 80 of the tank. A heat medium chamber 74 with a predetermined space is defined between the upper and lower partition plates 76 and 78. The upper pooling chamber 70*a* (with an open top) and the lower pooling chamber 70b are communicated with each other by a number of vertically disposed heat exchange pipes 72 as shown in FIG. 3, the heat exchange pipes 72 being inserted in the heat medium chamber 74 and constantly held in contact with the heat medium (for example, heated water). Preferably, the heat exchange pipes 72 are copper pipes with fins 82** at suitable intervals on the outer peripheries thereof.

One end of a steam feed pipe 84 which is connected to a steam source, not shown, at the other end is opened into the heat medium chamber 74 substantially at the center of its bottom portion, forcibly blowing saturated steam into the heat medium to raise its temperature to a range of, for example, 52° C.+4° C. to 52° C.−4° C. As shown particularly in FIG. 4, the center of the top wall of the heat medium chamber 74 is opened to the air to release gaseous components of the blown-in steam. A support member 88 is bridged between upright posts 86 which support the load of the tank 44, and a motor 90 which is mounted on the support member 88 is connected to an agitator 92. This agitator 92 is inserted into the heat medium chamber 74 through the afore-mentioned top opening to stir the heat medium uniformly.

As clear from FIGS. 3 and 4, the upper pooling chamber 70a is divided into two sections A and B by upright partition walls 94 which are connected by reinforcing members 102. As seen in FIG. 3, a horizontally extending diffuser plate 96 is fixedly mounted on the upright wall 94 in section A. Disposed over the diffuser plate 96 are the open ends of the glue feed pipe 68 from the inner tank 58 and the glue return pipe 48 from the glue pan 32. Namely, the starch glue from the subtank 52 and glue pan 32 is poured into the section A, and uniformly distributed over the section A by the diffuser plate 96.

A rotary pump 100 with an impeller 98 is provided at the bottom of the lower pooling chamber 70b as shown in FIG. 3 to circulate the starch glue in the pooling chamber 70a, heat exchange pipes 72 and lower pooling chamber 70b forcibly and positively. Namely, upon driving the rotary pump 100, the starch glue 34 supplied to the section A of the upper pooling chamber 70a is urged into the lower pooling chamber 70b through the heat exchange pipes 72 on the right side in the drawing, and then caused to climb up through the heat exchange pipes 72 on the left side to enter the section B of the upper pooling chamber 70a. While being passed through the heat exchange pipes 72, the starch glue is heated by the heat medium to a temperature of, for instance, 49° C.+2° C. to 49° C.−2° C., and part of the glue is sent to the pipe 46 leading to the glue pan 32, through an overflow pipe 104 and 3-way valve 106. The glue pan 32 is provided with a glue return pipe 48 as described hereinbefore to circulate the glue to the section A of the upper pooling chamber 70a of the heater 44.

Figure 5:
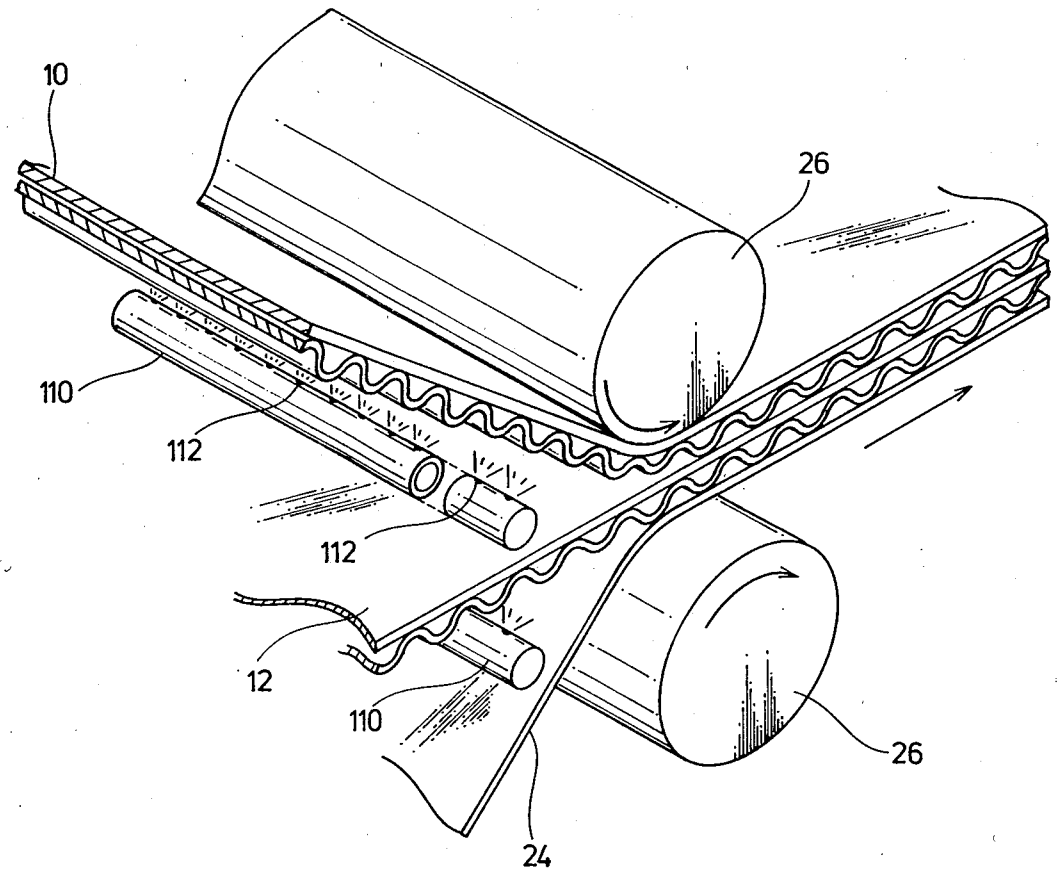
FIG. 5 is a fragmentary perspective view of a mechanism for blasting saturated steam on ridge portions to which a starch glue has been applied, for heating the glue in an accelerated manner.

Referring now to FIG. 5, there is shown an example of steam blow pipes 110 located immediately upstream of guide rolls 26 between which single-faced corrugated boards 10 and 12 and a liner are bonded together, thereby to accelerate heating of the glue applied on the ridge portions of the corrugated core sheets to be bonded to the back liner of the single-faced corrugated board 12 and a liner sheet 24. Namely, the steam blow pipes 110 are each provided with a multitude of steam blow holes 112 at suitable intervals along the length thereof, the steam blow holes 112 being directed toward the ridge portions of the corrugated sheets. Accordingly, the starch glue which is applied on the ridge portions of each corrugated sheets is quickly heated by hot saturated steam which is blown out under pressure from the steam blow holes 112.

The glue feeder with the above-described construction according to the invention operates in the manner as follows. As shown particularly in FIG. 2, the starch glue 34 which is stored in the stock tank 50 is once pooled in the inner tank 58 of the subtank 52 in the particular embodiment shown, and warmed up to a temperature of 40° C.+2° C. to 40° C.−2° C. by the heated water or other heat medium in the outer tank 60 prior to supply to the section A of the upper pooling chamber 70a of the glue heater 44 through the pipe 68. At this time, the heat medium, for example, heated water which is filled around the heat exchange pipes 72 in the heat medium chamber 74 is heated up to a temperature of 52° C.+4° C. to 52° C.−4° C. by saturated steam which is forcibly blown into the heat medium through the steam feed pipe 84. The starch glue 34 which is held in the section A of the upper pooling chamber 70a is circulated into the lower pooling chamber 70b through the heat exchange pipes 72 and then to the section B of the upper pooling chamber 70a through other heat exchange pipes 72 by operation of the pump 100. In the course, the starch glue 34 is heated to a temperature of about 49° C.+2° C. to 49° C.−2° C. by heat exchange, and part of the heated glue is sent to the pipe 46 through the overflow pipe 104 by the glue feed pump 108 for supply to the glue pan 32 of the glue applicator.

The starch glue 34 which is supplied to the glue pan 32 of the glue applicator in this manner is heated during passage through the heater 44 to a temperature range which is approximately 10° C. lower than its gelling temperature, for example, to a temperature range of 49° C.+2° C. to 49° C.−2° C. Accordingly, when the glue is applied to the ridge portions of the respective single-faced corrugated boards by the applicator rolls 28, it is already heated up to a relatively high temperature. It follows that, after bonding together the single-faced corrugated boards and a back liner (liner 24) through the guide rolls 26, the starch glue can be heated up to its gelling temperature by slight heating to produce its adhesive force. Namely, the heating zone which is constituted by the heat boxes 36 suffices to apply heat of a relatively small calorific value to the bonded corrugated board, and as a result its length can be reduced to a considerable degree as compared with the conventional counter-part which occupies a large space. Besides, it becomes possible to shorten the time period for heating the applied starch glue on the ridge portions of the corrugated paper to its gelling temperature, permitting to speed up the sheet bonding operation as well as a series of operations performed by a corrugator machine for improvement of production efficiency. Further, even if the operational speed of a corrugator line is slowed down, there is less possibility of the corrugated board suffering from warping or other defects due to overheating. In the case of the embodiment shown in FIG. 5, the temperature of the starch glue which is applied on the ridge portions of the corrugated paper in preheated state can be raised quickly by blowing hot saturated steam thereagainst from the steam pipe 110 immediately before bonding the corrugated sheet and liner together.

As explained in detail hereinbefore, the present invention provides a glue applicator for corrugator machines, in which a starch glue to be circulated to a glue pan is preheated to a predetermined temperature, so that it suffices to heat the glue only to a slight degree which is necessary for gelation thereof after applying the same on the ridge portions of the corrugated core sheet and bonding a liner thereto. Consequently, the length of the heating zone can be shortened to a significant degree which can contribute to remarkable savings of spaces in a corrugated board manufacturing plant.

Obviously, many modifications and variations of the present invention are possible in light of the above teachings. It is therefore to be understood that within the scope of the appended claims, the present invention may be practiced otherwise than as specifically described herein.

What is claimed is:

1. Glue applicator apparatus, for use with a system in which glue disposed within a glue pan is applied to the ridge portions of a corrugated core sheet, comprising:

tank means for holding a stock of said glue;

glue heating means for providing heated glue to said glue pan, including a first upper glue pool chamber into which said glue from said tank means is deposited; a second upper glue pool chamber, separated from said first upper glue pool chamber, from which said heated glue is discharged to said glue pan; a lower glue pool chamber, vertically spaced below said first and second upper glue pool chambers, for transferring said glue from said first upper glue pool chamber to said second upper glue pool chamber; a heat medium chamber, defined between said upper glue pool chambers and said lower glue pool chamber, for containing a heat medium; a first set of vertically extending heat exchanger pipes, interposed between said first upper glue pool chamber and said lower glue pool chamber and extending through said heat medium chamber in a heat exchange relationship with said heat medium disposed within said heat medium chamber, for transferring said glue from said first upper glue pool chamber to said lower glue pool chamber; a second set of vertically extending heat exchanger pipes, interposed between said lower glue pool chamber and said second upper glue pool chamber and extending through said heat medium chamber in a heat exchange relationship with said heat medium disposed within said heat medium chamber, for transferring said glue from said lower glue pool chamber to said second upper glue pool chamber; and a steam inlet feed pipe fluidically connected to said heat medium chamber for providing steam thereinto;

first conduit means for conducting said glue from said tank means to said first upper glue pool chamber of said glue heating means; and second conduit means for conducting said heated glue from said second upper glue pool chamber to said glue pan.

2. The glue applicator as set forth in claim 1, wherein said glue applicator further comprises a pump for circulating said starch glue from said first section upper glue pool chamber to said second section upper glue pool chamber through said first and second sets of heat exchange pipes.

3. The glue applicator as set forth in claim 2, further comprising a glue return pipe connected between said glue pan and said first upper pooling chamber to circulate said starch glue thereto.

4. The glue applicator as set forth in claim 3, wherein said glue heater further comprises a diffuser plate fixedly mounted in said first upper glue pool chamber for distributing the starch glue from said stock tank and glue pan uniformly within said first upper pooling chamber.

5. Glue applicator apparatus as set forth in claim 1, further comprising:

agitating means disposed within said heat medium for stirring said heat medium so as to maintain the temperature thereof substantially uniform throughout said heat medium.

6. Glue applicator apparatus as set forth in claim 1, further comprising:

agitating means disposed within said tank means holding said stock of glue for stirring said stock of glue so as to maintain the concentration of said glue substantially constant throughout said stock of glue.

7. Glue applicator apparatus as set forth in claim 1, further comprising:

sub-tank means interposed between said tank means and said glue heating means for pre-heating said glue supplied to said glue heating means from said tank means.

8. Glue applicator apparatus as set forth in claim 7, wherein said sub-tank means comprises:

an outer tank;

a heating medium disposed within said outer tank; and an inner tank disposed within said outer tank and fluidically interconnecting said tank means and said glue heating means for supplying pre-heated glue from said tank means to said glue heating means.

9. Glue applicator apparatus as set forth in claim 8, further comprising:

agitating means disposed within said inner tank for stirring said pre-heated glue disposed within said inner tank so as to maintain the temperature of said pre-heated glue disposed within said inner tank substantially uniform throughout said pre-heated glue.

10. Glue applicator apparatus, for use with a system in which glue disposed within a glue pan is applied to the ridge portions of a corrugated core sheet, comprising:

tank means for holding a stock of said glue;

glue heating means for providing heated glue to said glue pan, including a first upper glue pool chamber into which said glue from said tank means is deposited; a second upper glue pool chamber, separated from said first upper glue pool chamber, from which said heated glue is discharged to said glue pan; a lower glue pool chamber, vertically spaced below said first and second upper glue pool chambers, for transferring said glue from said first upper glue pool chamber to said second upper glue pool chamber; a heat medium chamber, defined between said upper glue pool chambers and said lower glue pool chamber, for containing a heat medium; a first set of vertically extending heat exchanger pipes, interposed between said first upper glue pool chamber and said lower glue pool chamber and extending through said heat medium chamber in a heat exchange relationship with said heat medium disposed within said heat medium chamber, for transferring said glue from said first upper glue pool chamber to said lower glue pool chamber; a second set of vertically extending heat exchanger pipes, interposed between said lower glue pool chamber and said second upper glue pool chamber and extending through said heat medium chamber in a heat exchange relationship with said heat medium disposed within said heat medium chamber, for transferring said glue from said lower glue pool chamber to said second upper glue pool chamber; and a steam inlet feed pipe fluidically connected to said heat medium chamber for providing steam thereinto;

first conduit means for conducting said glue from said tank means to said first upper glue pool chamber of said glue heating means;

second conduit means for conducting said heated glue from said second upper glue pool chamber to said glue pan; and means for supplying steam to said ridge portions of said corrugated core sheet at a position immediately upstream of the location at which said corrugated core sheet is to be bonded to a liner for heating said glue applied to said ridge portions of said corrugated core sheet so as facilitate said bonding of said corrugated core sheet to said liner.

11. Apparatus as set forth in claim 10, wherein:

said steam supply means comprises at least one pipe extending transversely across the width of said corrugated core sheet and said liner, and having a plurality of holes defined therein from which said steam is exhausted toward said ridge portions of said corrugated core sheet.

12. Apparatus as set forth in claim 10, further comprising:

pump means disposed within said lower glue pool chamber for circulating said glue from said first upper glue pool chamber to said second upper glue pool chamber by means of said first set of heat exchange pipes, said lower glue pool chamber, and said second set of heat exchanger pipes.

13. Apparatus as set forth in claim 10, further comprising:

third conduit means for circulating said glue from said glue pan back to said first upper glue pool chamber.

14. Apparatus as set forth in claim 13, further comprising:

a diffuser plate fixedly mounted within said first upper glue pool chamber for distributing said glue from said from said tank means and said glue pan uniformly throughout said first upper glue pool chamber.

15. Apparatus as set forth in claim 10, further comprising:

agitating means disposed within said heat medium for stirring said heat medium so as to maintain the temperature thereof substantially uniform throughout said heat medium.

16. Apparatus as set forth in claim 10, further comprising:

agitating means disposed within said tank means holding said stock of glue for stirring said stock of glue so as to maintain the concentration of said glue substantially uniform throughout said stock of glue.

17. Apparatus as set forth in claim 10, further comprising:

sub-tank means interposed between said tank means and said glue heating means for pre-heating said glue supplied to said glue heating means from said tank means.

18. Apparatus as set forth in claim 17, wherein said sub-tank means comprises:

an outer tank;

a heating medium disposed within said outer tank; and an inner tank disposed within said outer tank and fluidically interconnecting said tank means and said glue heating means for supplying pre-heated glue from said tank means to said glue heating means.

19. Apparatus as set forth in claim 18, further comprising:

agitating means disposed within said inner tank for stirring said pre-heated glue disposed within said inner tank so as to maintain the temperature of said pre-heated glue disposed within said inner tank substantially uniform throughout said pre-heated glue.

20. Apparatus as set forth in claim 18, further comprising:

a second steam inlet feed pipe fluidically connected to said outer tank for providing steam thereinto so as to heat said heating medium disposed within said outer tank.

* * * * *